US010550611B2

(12) United States Patent
Och

(10) Patent No.: US 10,550,611 B2
(45) Date of Patent: Feb. 4, 2020

(54) SYSTEM COMPOSED OF A DOOR HANDLE AND OF AN ACTUATION DEVICE FOR THE DOOR HANDLE

(71) Applicant: ILLINOIS TOOL WORKS INC., Glenview, IL (US)

(72) Inventor: Roland Och, Rottendorf (DE)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/036,837

(22) PCT Filed: Nov. 18, 2014

(86) PCT No.: PCT/US2014/066068
§ 371 (c)(1),
(2) Date: May 16, 2016

(87) PCT Pub. No.: WO2015/074020
PCT Pub. Date: May 21, 2015

(65) Prior Publication Data

US 2016/0298366 A1 Oct. 13, 2016

(30) Foreign Application Priority Data

Nov. 18, 2013 (DE) ..... 10 2013 112 706

(51) Int. Cl.
*E05B 85/10* (2014.01)
*E05B 85/12* (2014.01)
*E05B 81/06* (2014.01)

(52) U.S. Cl.
CPC ..... *E05B 85/107* (2013.01); *E05B 85/103* (2013.01); *E05B 85/12* (2013.01);
(Continued)

(58) Field of Classification Search
CPC ..... E05B 85/103; E05B 85/12; E05B 81/06; E05B 85/107; Y10T 292/57
(Continued)

(56) References Cited

U.S. PATENT DOCUMENTS 2,599,054 A * 6/1952 Gates ..... E05B 5/003 292/348
3,153,552 A * 10/1964 Sandor ..... E05B 85/14 292/336.3
(Continued)

FOREIGN PATENT DOCUMENTS

CN 200961395 Y 10/2007
DE 102004036663 A1 3/2006
(Continued)

OTHER PUBLICATIONS

ISR and WO for PCT/US2014/066068 mailed Mar. 25, 2015.

*Primary Examiner* — Carlos Lugo
*Assistant Examiner* — Faria F Ahmad
(74) *Attorney, Agent, or Firm* — Quarles & Brady LLP

(57) ABSTRACT

A door handle, which can be mounted in movable fashion in or on an automobile, and of an actuation device for the door handle, wherein the door handle has a handle section and two mounting sections arranged in the region of opposite ends of the handle section, wherein the actuation device comprises an actuation lever which, by one end thereof, is pivotably connected to a first of the mounting sections and, by the other end thereof, is mounted on a housing section so as to be pivotable between a rest position and an actuated position, wherein, when the actuation lever is in the rest position, the door handle assumes a closed position, and when the actuation lever is in the actuated position, the door
(Continued)

Figure 1:
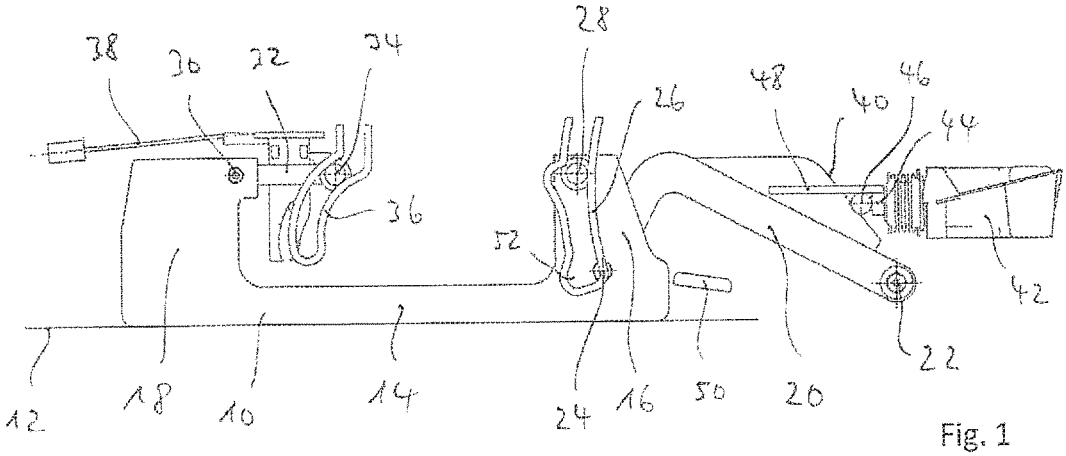

handle assumes an actuated position from which the door handle can be pulled manually into an open position in order to unlock a door lock.

19 Claims, 4 Drawing Sheets

(52) U.S. Cl.
CPC ..... *E05B 81/06* (2013.01); *E05B 85/10* (2013.01); *E05Y 2900/531* (2013.01); *Y10T 292/57* (2015.04)

(58) Field of Classification Search
USPC ..... 292/336.3, DIG. 31
See application file for complete search history.

(56) References Cited

U.S. PATENT DOCUMENTS 3,266,275 A * 8/1966 Atkinson ..... E05B 65/5269 292/204
3,694,017 A * 9/1972 Keeler, II ..... E05B 5/00 292/169.18
3,993,338 A * 11/1976 Cherbourg ..... B60J 5/06 292/336.3
5,123,687 A * 6/1992 Pfeiffer ..... E05B 1/0092 292/336.3
5,632,516 A * 5/1997 Schwab ..... E05B 85/18 292/336.3
6,698,262 B2 * 3/2004 Wittwer ..... E05B 85/107 292/336.3
8,282,142 B2 * 10/2012 Fannon ..... E05B 79/12 292/336.3
8,443,553 B1 * 5/2013 Polewarczyk ..... E05B 81/77 16/412
8,701,353 B2 * 4/2014 Patel ..... E05B 81/34 292/144
8,833,813 B2 * 9/2014 Muller ..... E05B 85/16 292/336.3
8,919,047 B2 * 12/2014 Johnsrud ..... E05B 85/103 292/336.3
9,062,478 B2 * 6/2015 Bingle ..... E05B 81/28
9,080,352 B2 * 7/2015 Aerts ..... E05B 85/103
9,103,143 B2 * 8/2015 Wheeler ..... B60Q 3/002
9,187,937 B2 * 11/2015 Schryer ..... B60N 3/026
9,249,608 B2 * 2/2016 Lang ..... E05B 85/103
9,719,277 B2 * 8/2017 Brown ..... E05B 81/06
2004/0031301 A1 * 2/2004 Dominique ..... E05B 41/00 70/237
2011/0174102 A1 7/2011 Beck
2013/0076048 A1 3/2013 Aerts et al.
2013/0121008 A1 5/2013 Mueller et al.
2013/0241215 A1 * 9/2013 Halliwell ..... E05B 85/107 292/336.3
2014/0132012 A1 * 5/2014 Yoshino ..... E05B 85/103 292/336.3
2014/0265372 A1 * 9/2014 Smart ..... E05B 85/103 292/336.3

FOREIGN PATENT DOCUMENTS

DE 102008019335 A1 10/2008
DE 102010016869 A1 11/2011
DE 102008057933 B4 10/2012
GB 2477085 A 7/2011

* cited by examiner

SYSTEM COMPOSED OF A DOOR HANDLE AND OF AN ACTUATION DEVICE FOR THE DOOR HANDLE

RELATED APPLICATIONS

The present application is a National Phase of International Application Number PCT/US2014/066068, filed Nov. 18, 2014, and claims priority to German Application Number 10 2013 112 706.1, filed Nov. 18, 2013.

The invention relates to a system composed of a door handle, which can be mounted in movable fashion in or on an automobile, and of an actuation device for the door handle, wherein the door handle has a handle section and two mounting sections arranged in the region of opposite ends of the handle section. Door handles of said type are used for example as exterior door handles on automobile doors. For example, DE 10 2004 036 663 A1 has disclosed an exterior door handle which, in its closed position, terminates flush with the body of the motor vehicle. From the closed position, the door handle can be pivoted up into an operating position in which it protrudes from the body and from which it can be manually pulled up further in order to unlock the door lock.

It is in some cases desirable for a door handle which terminates flush with the exterior skin of the surrounding body to be moved in translational fashion from its closed position into an actuated position from which the door handle can be pulled up manually. Known solutions for implementing such a translational movement of the door handle involve considerable outlay in terms of construction and require a large amount of structural space, inter alia in the vertical direction of the automobile.

Proceeding from the prior art discussed, it is the object of the invention to provide a system of the type mentioned in the introduction with which a door handle can be moved in translational fashion between a closed position and an actuated position, wherein the system should involve less outlay in terms of construction and should have a smaller structural space requirement.

The invention achieves the object by way of the subject matter of claim 1. Advantageous refinements emerge from the dependent claims, from the description and from the figures.

For a system of the type mentioned in the introduction, the invention achieves the object in that the actuation device comprises an actuation lever which, by one end thereof, is pivotably connected to a first of the mounting sections and, by the other end thereof, is mounted on a housing section so as to be pivotable between a rest position and an actuated position, wherein, when the actuation lever is in the rest position, the door handle assumes a closed position, and when the actuation lever is in the actuated position, the door handle assumes an actuated position from which the door handle can be pulled manually into an open position in order to unlock a door lock, wherein the actuation device comprises drive means for the movement of the actuation lever from the rest position into the actuated position, and wherein the actuation device furthermore comprises at least one slotted guide in which, at least during a movement of the actuation lever between the rest position and the actuated position, the first mounting section or the second mounting section is guided by way of at least one guide section such that the door handle is moved in substantially translational fashion between its closed position and its actuated position.

The door handle may be an interior or exterior door handle of an automobile. It may, when in the closed position, terminate flush with the surrounding exterior surface of the vehicle body. It is then the case in particular that no grip recess or the like is provided. It is also possible in a manner known per se for damping means, for example linear or rotary dampers, to be provided which dampen the movement of the door handle.

By means of the actuation device according to the invention, the door handle is moved in translational fashion from its closed position into its actuated position and vice versa. In particular, in this case, the mounting sections formed at the opposite ends of the handle section move parallel to one another. It is thus in particular the case that the door handle is not pivoted during its movement from the closed position into the actuated position. In the installed state in an automobile, the translational movement of the door handle generally takes place substantially perpendicular to the longitudinal direction of the automobile. The translational movement is, according to the invention, realized through the interaction of the actuation lever and the slotted guide for the guide section of the first or second mounting section. The actuation lever is pivotably connected at one side to the first mounting section of the door handle. At the other side, said actuation lever is pivotably mounted on a housing section of the system. During operation, the housing section is arranged fixedly on the automobile door. The slotted guide forms a curved path for the guide section, along which the guide section runs during the course of the movement of the door handle. The guide section may for example be formed by an end of a, for example, cylindrical guide bar. It is also possible for both ends of a guide bar of said type to each form a guide section. The ends of the guide section of the guide bar may then each be guided in a slotted guide. The actuation lever is moved by the drive means, wherein the guide section runs along the curved path defined by the guide slot. The curved path is suitably designed such that the door handle performs the desired translational movement. From the actuated position, the door handle can then be pulled manually into the open position in order to unlock the door lock.

By means of the construction according to the invention, a design is realized which is more compact in relation to the prior art. This applies firstly to the structural depth of the system in the direction of movement of the door handle from the actuated position into the closed position, that is to say in particular perpendicular to the longitudinal direction of an automobile. In this direction, it is possible for the system according to the invention to have an extent of less than 80 mm in the closed position of the door handle. The height of the system perpendicular to the longitudinal direction of the handle section, that is to say in particular in the vertical direction (z direction) of an automobile equipped with the door handle, is also considerably reduced in relation to the prior art. For example, it is possible for the extent of the system in said direction to likewise be less than 80 mm in the closed position of the door handle.

The actuation lever may for example comprise two lever arms which run at an angle with respect to one another, one of which lever arms is pivotably mounted by one free end thereof on the housing of the system, and the other of which lever arms is pivotably connected by one free end thereof to the first mounting section of the door handle. These two pivot axes of the actuation lever may, when the actuation lever is in the rest position and/or the door handle is in the closed position, be situated in a plane running parallel to the exterior surface of the handle section. In the rest position, the actuation lever may be arranged in front of or behind the door handle as viewed in the longitudinal direction of the handle section.

The invention also relates to an automobile door or to an automobile having a system according to the invention. It may then be the case that the door handle, for example in the form of an exterior door handle, when in its closed position, terminates flush with the surrounding exterior surface of the automobile door as explained above.

For a further increase in convenience, spring means may be provided which preload the actuation lever into the rest position. Alternatively or in addition, spring means may be provided which preload the door handle into the actuated position and/or the closed position. The preloading of the actuation lever into the rest position has the effect that the actuation lever is automatically returned into the rest position, driving the door handle with it. However, the door handle would then possibly still be situated in a pivoted-out position. By means of the possibly additionally provided preload of the door handle, it is ensured that said door handle is moved back fully into the closed position after the door handle, in the open position, has been released. It is also ensured that the door handle cannot move out of the closed position of its own accord. If it is the intention to implement both of the preloads discussed, this may be realized by way of separate spring means for the actuation lever and for the door handle or by way of common spring means which realize both preloads.

In a further refinement, the door handle may be pivotable, in particular manually pivotable, between the actuated position and the open position about the pivot spindle which connects the actuation lever to the first mounting section. Thus, during the movement of the door handle from the actuated position into the open position, the door handle pivots relative to the actuation lever, specifically about the pivotal connection between the actuation lever and the door handle. The actuation lever may, in the actuated position, bear against a stop which prevents the actuation lever from being able to be pivoted further out of the actuated position. The pivoting of the door handle relative to the actuation lever is permitted in this way.

In a further refinement, it may be provided that the at least one slotted guide which guides the at least one guide section of the first or second mounting section has, at its end which receives the guide section when the door handle is in the actuated position, an in particular lateral protuberance in which the at least one guide section is received when the door handle is in the open position. The at least one guide section is thus guided in the at least one slotted guide at all times during the movement of the door handle from the closed position into the open position and vice versa.

In a further refinement, it may be provided that, for emergency unlocking of the door lock, the door handle can be pivoted manually about the pivot spindle, which connects the actuation lever to the first mounting section, from the closed position into an emergency unlocking position, wherein the at least one slotted guide which guides the at least one guide section of the first or second mounting section has, at its end which receives the at least one guide section when the door handle is in the closed position, an in particular lateral protuberance in which the at least one guide section is received when the door handle is in the emergency unlocking position. The emergency unlocking function serves for opening the automobile door for example if the drive means are defective. To open the door lock, the door handle may be pivoted up from the emergency unlocking position into an emergency open position. To move the door handle into the emergency unlocking position, the first mounting section may for example manually be pushed in slightly, whereby the door handle is pivoted outward slightly in the region of the second mounting section and can be manually gripped in order to be pivoted up into the emergency open position.

The pivotable connection of the actuation lever to the first mounting section and the at least one guide section of the first mounting section may be provided at opposite ends of the first mounting section. The pivotable connection of the actuation lever to the first mounting section and the guide section of the first mounting section are in particular spaced apart from one another in the direction of movement of the first mounting section between the closed position and the actuated position. By means of this configuration, the stability of the translational movement of the door handle is increased.

In a further refinement, it may be provided that the first mounting section is guided by way of at least one guide section in the at least one slotted guide, wherein, at least during a movement of the actuation lever between the rest position and the actuated position, the second mounting section is guided by way of at least one guide section in at least one second slotted guide, or that the second mounting section is guided by way of at least one guide section in the at least one slotted guide, wherein, at least during a movement of the actuation lever between the rest position and the actuated position, the first mounting section is guided by way of at least one guide section in at least one second slotted guide. It is thus possible for the two mounting sections to each be guided by way of a guide section in at least one slotted guide.

If the second mounting section is guided in at least one second slotted guide, it is possible, in the event of a movement, or during the movement, of the door handle between the closed position and the open position, for the second mounting section to be guided by way of its guide section by way of its at least one guide section in the at least one second slotted guide assigned thereto.

Furthermore, the second mounting section may interact with a door lock, which is to be actuated by way of the door handle, such that the door lock is unlocked when the door handle is in the open position. On the second mounting section, there may be pivotably mounted an unlocking lever, on the free end of which the at least one guide section is formed. The one or more guide sections of the second mounting section may be connected to the door lock for example by way of a Bowden cable. The above-mentioned refinements make it possible to realize unlocking of the door lock in a simple manner in terms of construction. The second mounting section may drive a Bowden cable of the door lock along with it during the movement of the door handle into the open position. Here, the Bowden cable may be tensioned during the course of the unlocking of the door, such that the door lock can also be locked again during a subsequent movement of the door handle back into the actuated or closed position.

In a further refinement, the drive means may be connected to a first end of a thrust rod, the second end of which acts (directly or indirectly) on the unlocking lever such that, when the actuation lever is situated in the actuated position, a movement of the door handle from the actuated position into the closed position is prevented. In this regard, it may also be provided that the thrust rod interacts with a blocking element, in particular a pawl, which acts on the unlocking lever, that the blocking element is mounted so as to be movable between a block position, which prevents a movement of the door handle from the actuated position into the closed position, and a release position, which permits a movement of the door handle from the actuated position into the closed position, in particular is mounted pivotably on a housing section, and that the thrust rod moves the blocking element into its block position during a movement of the actuation lever into its actuated position by the drive means, and said thrust rod holds said blocking element in the block position for as long as the drive means are situated in a position which holds the actuation lever in the actuated position.

In this refinement, a thrust rod which is actuated by the drive means, and which is in particular connected to the drive means, acts on the second mounting section, in particular on the unlocking lever of the second mounting section, such that, when the actuation lever is situated in the actuated position and the thrust rod is situated in a position associated therewith, the door handle cannot be moved from the actuated position into the closed position. A situation is thus prevented in which the door handle is inadvertently pushed inward from the actuated position and damage could be caused to components of the system. In particular, in this case, the thrust rod may act on the unlocking lever of the second mounting section via the blocking element which is in particular in the form of a pivotably mounted pawl, that is to say indirectly. The blocking element affords the structural stability required to prevent damage resulting from an exertion of pressure on the door handle situated in the actuated position. As a result of the provision of the blocking element, it is not necessary for the thrust rod, or for the thrust rod on its own, to absorb any occurring pressure force, and said thrust rod can therefore be dimensioned to be smaller. Only when the actuation lever moves out of the actuated position back into its rest position, and the thrust rod correspondingly moves back into its initial position, does the blocking element release the unlocking lever, and thus the second mounting section of the door handle, such that the door handle can move back into its closed position. In this case, the thrust rod or the blocking element can in particular prevent any movement of the door handle from the actuated position into the closed position, that is to say can hold the door handle in the actuated position. The blocking element may be preloaded into the release position by a spring element, such that the release of the door handle during a movement of the actuation lever from the actuated position back into its rest position is effected by the spring preload.

The blocking element is preferably guided, by way of a blocking section, in a slot formed on the second end of the thrust rod. The blocking section may for example be in the form of a blocking projection. The slot may extend with its longitudinal axis in particular in the axial direction of the thrust rod. The slot has the effect that, during a movement of the actuation lever from its rest position into its actuated position, the thrust rod initially moves relative to the blocking element, without said movement acting on the blocking element. It is rather initially the case that the blocking section slides in the thrust rod which is moving in the axial direction, with the blocking element remaining stationary. In this way, the translational movement of the door handle effected by the slotted guide is not disrupted. Only when the blocking element reaches the end of the slot does the further axial displacement of the thrust rod lead to a movement of the blocking element, in particular a pivoting of the blocking element, into a position in which it comes into blocking engagement with the unlocking lever. During the return movement of the thrust rod, the latter releases the blocking element again and said blocking element can be moved back into its release position for example by way of a spring element.

The drive means may for example comprise an electric drive motor which pivots the actuation lever from the rest position into the actuated position. In particular, the drive means may comprise an electric linear drive which drives an element, in particular a sliding element or a roller, which runs on a ramp of the actuation lever. The linear drive has a drive part on which the element, for example the roller, is arranged. The drive part with the element is moved linearly or in translational fashion by the electric linear drive. In this way, the element is pushed in a linear direction onto the ramp, which forms an oblique plane. Under the action of the pressure exerted on the ramp by the element, the actuation lever is pivoted about its pivot spindle which is mounted on the housing section of the system. The element, for example the sliding element or the roller, may interact with an abutment guide running parallel to the direction of movement of the drive part of the linear drive, such that said element cannot deflect to the side. Here, it is advantageously the case that no lateral forces act on the drive part and thus on the electric motor of the linear drive. The abutment guide together with the ramp forms a wedge-shaped receptacle for the drive part with the element. Furthermore, as an alternative or in addition to a linear movement of the drive means or of the drive part, a rotational movement of the drive means or of the drive part for the purpose of driving the actuation lever is also possible, for example by means of an eccentric raceway or the like. It is also possible for the electric motor to move only in a direction for pivoting the actuation lever from its rest position into the actuated position. The electric motor may then subsequently perform a return movement, with the actuation lever being pivoted back into its rest position by suitable spring means. By virtue of the motor being decoupled from the actuation lever during the return movement of the motor into its initial position, antipinch protection is advantageously also realized because the door handle is moved back into the closed position under the drive action only of the spring. The spring force is low enough that injury to a user cannot occur.

It is also possible for the ramp to have, along the movement travel of the element on the ramp, at least two sections of different gradient. It is for example possible for three sections of different gradient to be provided. A first section may for example have a shallow gradient. A large force is then exerted on the actuation lever by means of the linear drive. This may be expedient for example during winter for breaking up any ice that has formed. Said first section may be adjoined for example by a second section of steeper gradient. In this way, (after the break-up of any ice) the movement of the door handle into the actuated position is accelerated because the actuation lever is pivoted more rapidly owing to the gradient. The second section may for example be adjoined by a third section, which again has a shallower gradient than the second section. High holding forces in the actuated position are realized in this way.

In an alternative embodiment, it is possible for the drive means to comprise a push-push kinematic arrangement, wherein the door handle can, by manual exertion of a pressure force counter to the preload of spring means in order to unlock the push-push kinematic arrangement, be moved out of its closed position into an unlocked position from which the door handle, driven by the preload of the spring means, is moved into the actuated position with a pivoting movement of the actuation lever. It is furthermore possible for the drive means to comprise a drive lever which is pivotably mounted on a housing section and which, after the unlocking of the push-push kinematic arrangement, is pivoted by the spring means so as to move the door handle, with a pivoting movement of the actuation lever, into the actuated position. In this case, the drive lever is pivotably mounted on a housing section of the system which is in particular arranged fixedly on the automobile door during operation. In this refinement, the actuation of the door handle is initiated manually by virtue of the door handle being pushed inward, whereby the push-push kinematic arrangement is unlocked and the door handle is moved out of the closed position into the actuated position.

In a further refinement in this regard, it is possible for a plunger of the push-push kinematic arrangement to be formed on the drive lever, wherein a control cam is formed on the outer side of the plunger, wherein, at least when the door handle is in the closed position, the plunger is surrounded by a control ring of the push-push kinematic arrangement, said control ring being mounted rotatably and in an axially fixed manner in a housing of the push-push kinematic arrangement, wherein the control ring has, on its inner side, at least one control projection which is guided in the control cam of the plunger, wherein, when the door handle is in the closed position, the plunger is locked on the control ring. During a movement of the door handle into the actuated position and subsequently into the open position, the plunger can emerge from the housing of the push-push kinematic arrangement and thus from the control ring. For locking to take place again, the plunger then moves into the housing and into the control ring again. In a manner known per se, the control cam has, for example, one or more axial grooves and one or more locking recesses. During an axial movement of the plunger into or out of the housing of the push-push kinematic arrangement, one or more control projections of the control ring are guided in the one or more axial grooves, and the control projection(s) of the control ring lock(s) in the one or more locking recesses. The push-push kinematic arrangement, in particular the interaction of control cam and control ring, may be configured as described in DE 10 2008 057 933 B4. For a particularly compact construction, the drive lever may be arranged in a space between the mounting sections when the door handle is in the closed position. This also applies to the slotted guide(s). The extent of the system in the direction of movement of the door handle from the actuated position into the closed position is then defined substantially by the extent of the mounting sections.

In a further refinement, it may be provided that the at least one guide section of the second mounting section, during the course of its guidance in the at least one (if appropriate second) slotted guide during a movement of the door handle from the actuated position into the open position, pivots the drive lever counter to the spring means of the drive lever such that the plunger is locked on the control ring again. During the course of the movement of the door handle from the actuated position into the open position, it is thus the case that the push-push kinematic arrangement is locked again, such that the door handle is subsequently movable from the open position into the closed position without an opposing force being exerted by the spring means of the drive lever. It is then possible, for example, for the door handle to be moved automatically into the closed position again by the spring preload of the actuation lever and/or of the door handle, without the spring means of the push-push kinematic arrangement imparting an opposing preload. Owing to the push-push kinematic arrangement being preloaded such that locking is generated again during the course of the manual opening of the door handle, a conflict of aims with regard to the spring means is resolved. Specifically, for the movement of the door handle from the closed position into the actuated position, it is necessary for the spring means of the push-push kinematic arrangement to have a more intense preload than any spring means that preload the actuation lever or the door handle into the rest position or the closed position. This would oppose automatic closure of the door handle. This is prevented by means of the discussed refinement.

Figure 2:
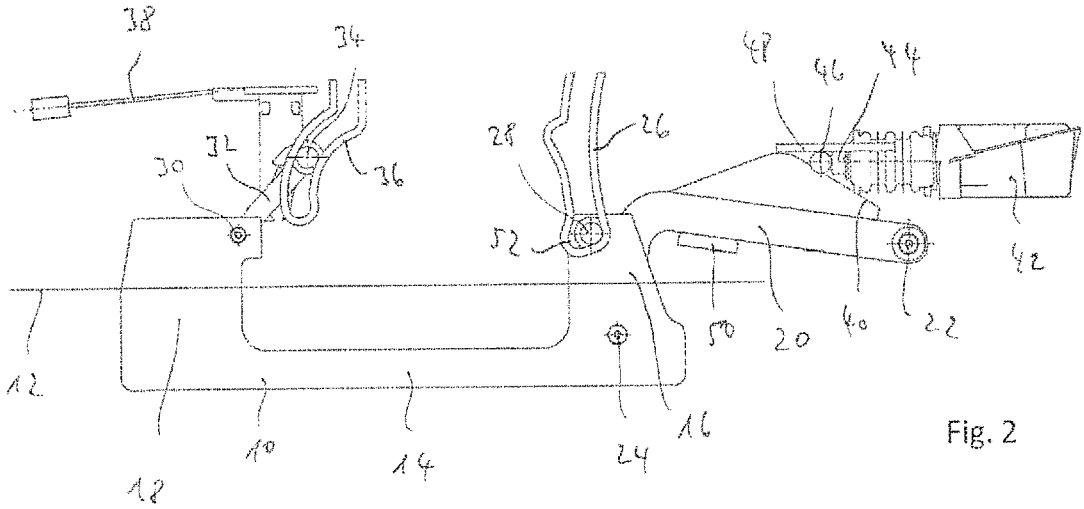
Figure 3:
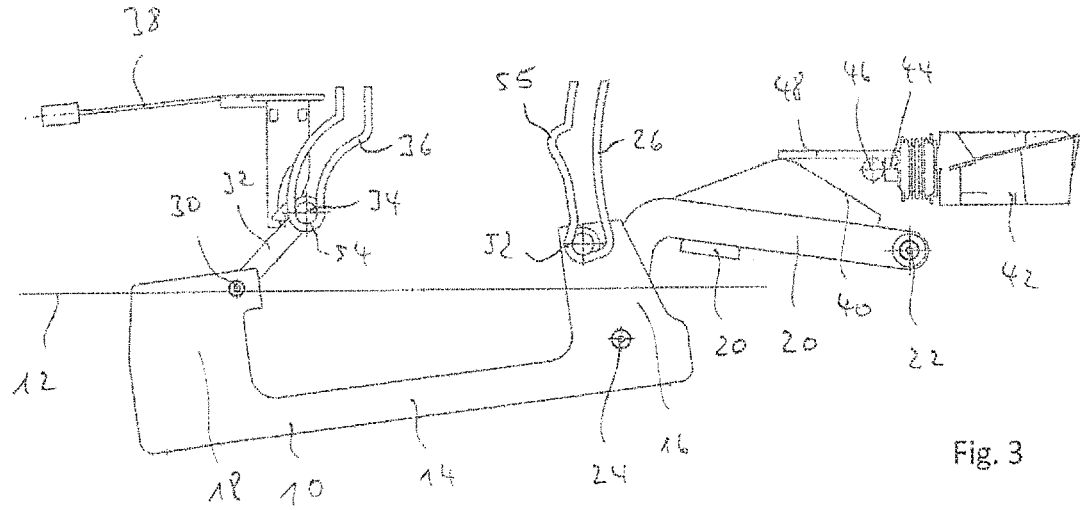
Figure 4:
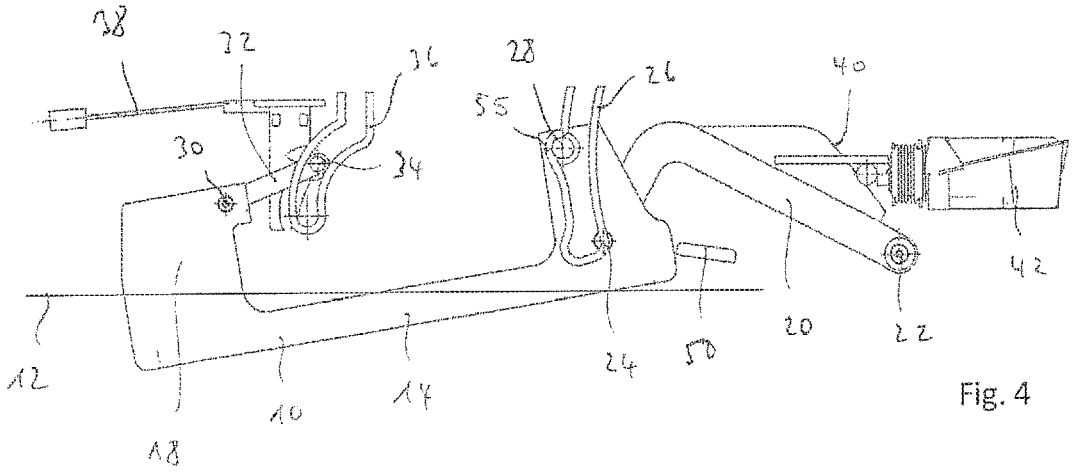
Figure 5:
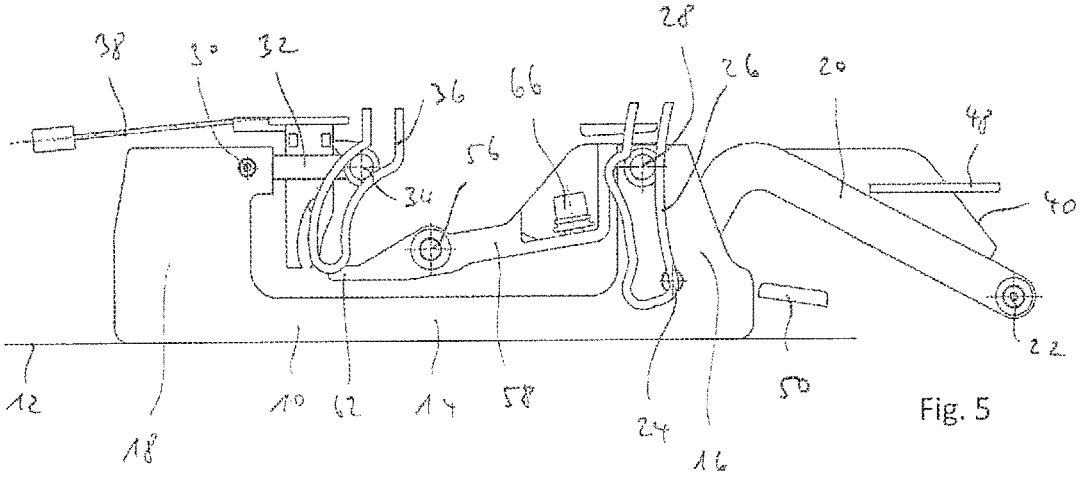
Figure 6:
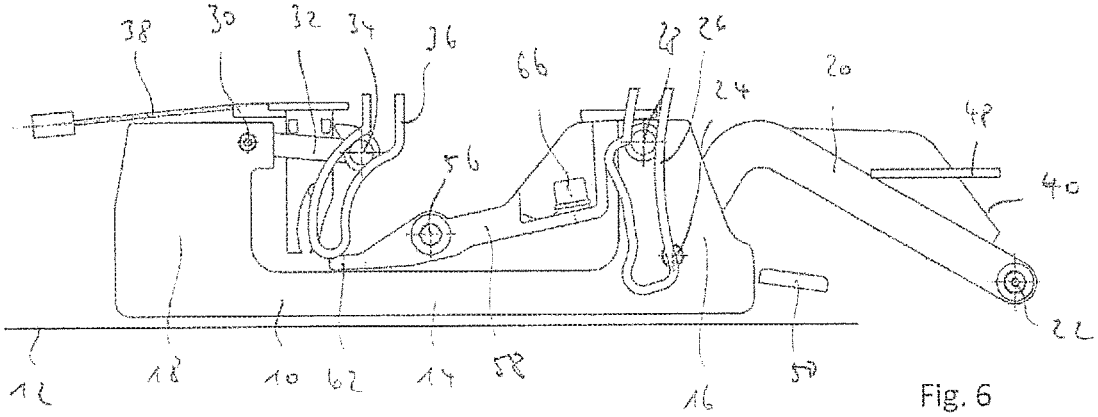
Figure 7:
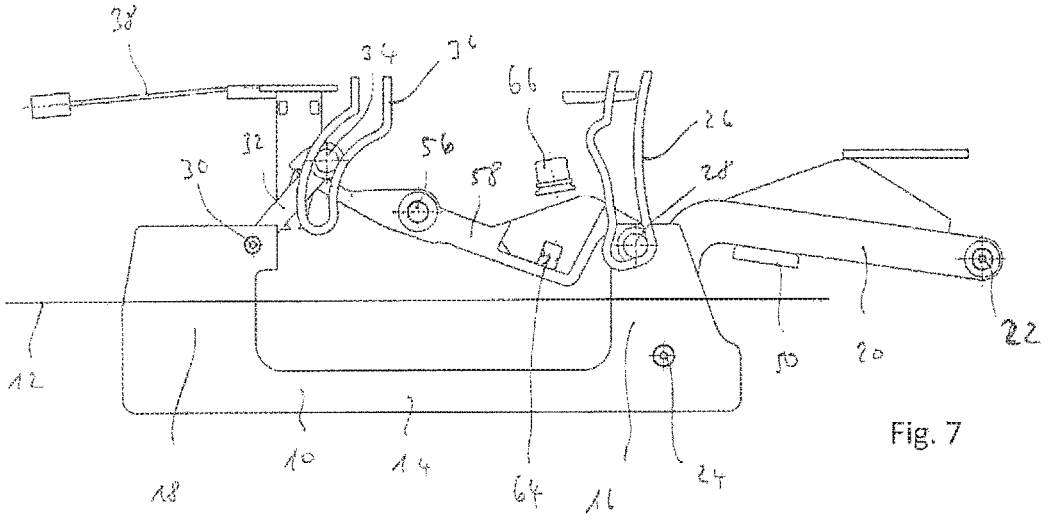
Figure 8:
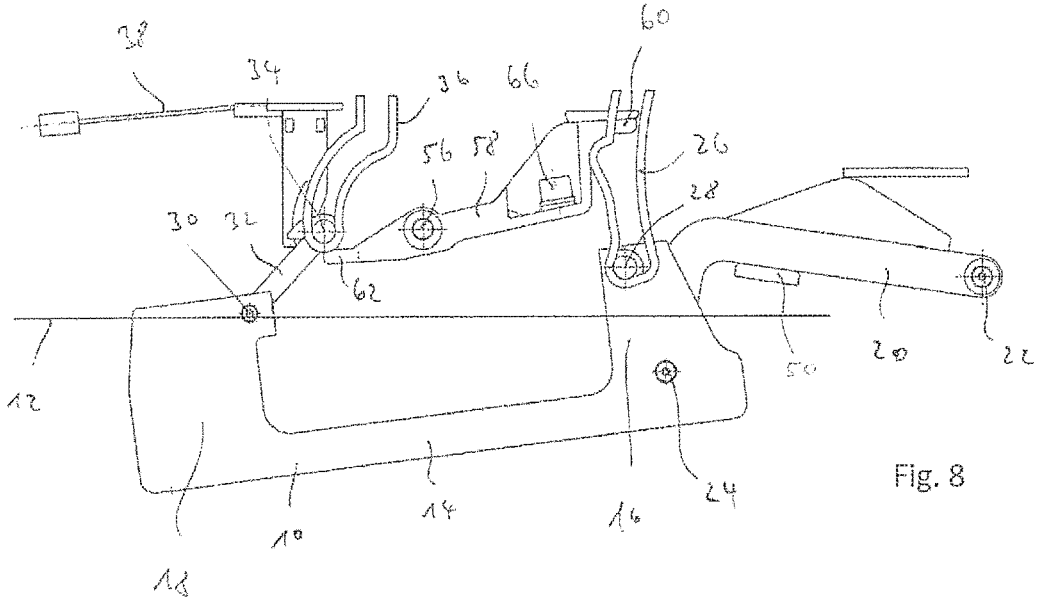
Figure 9:
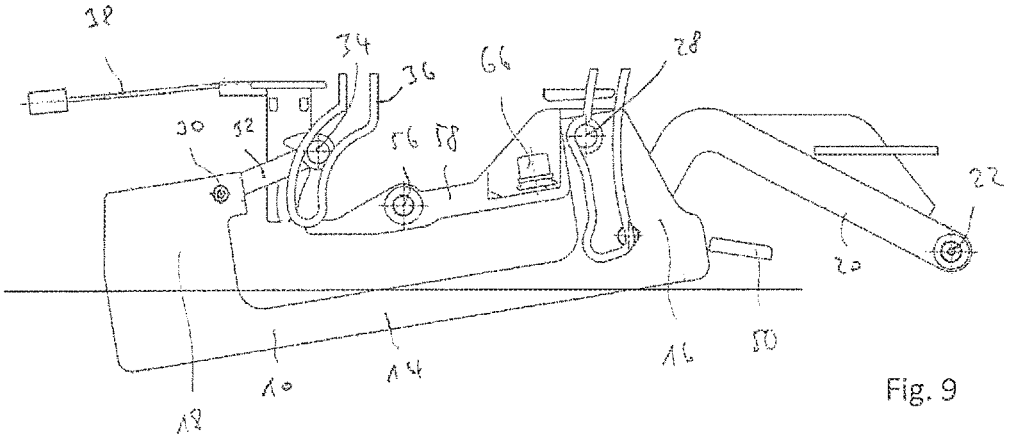
Figure 10:
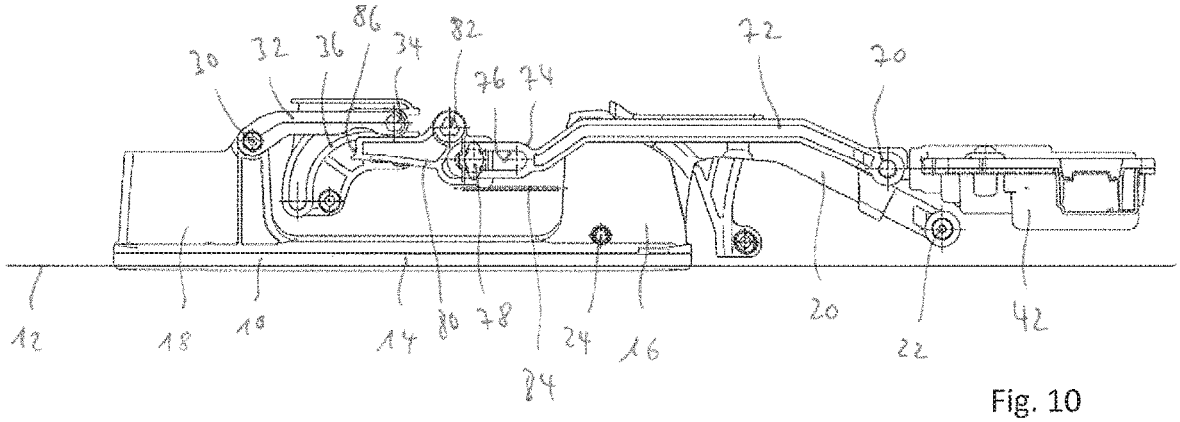
Figure 11:
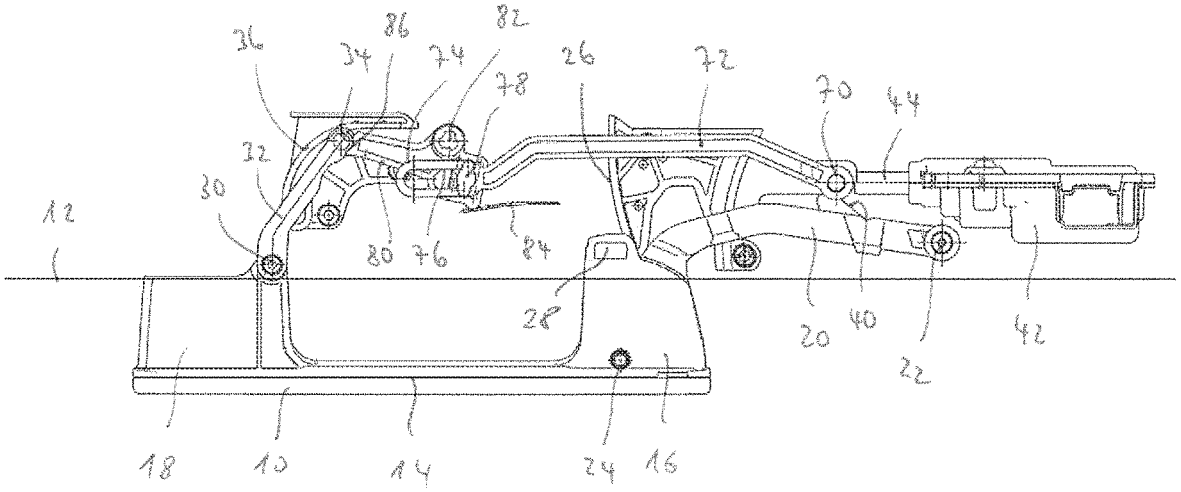
Figure 12:
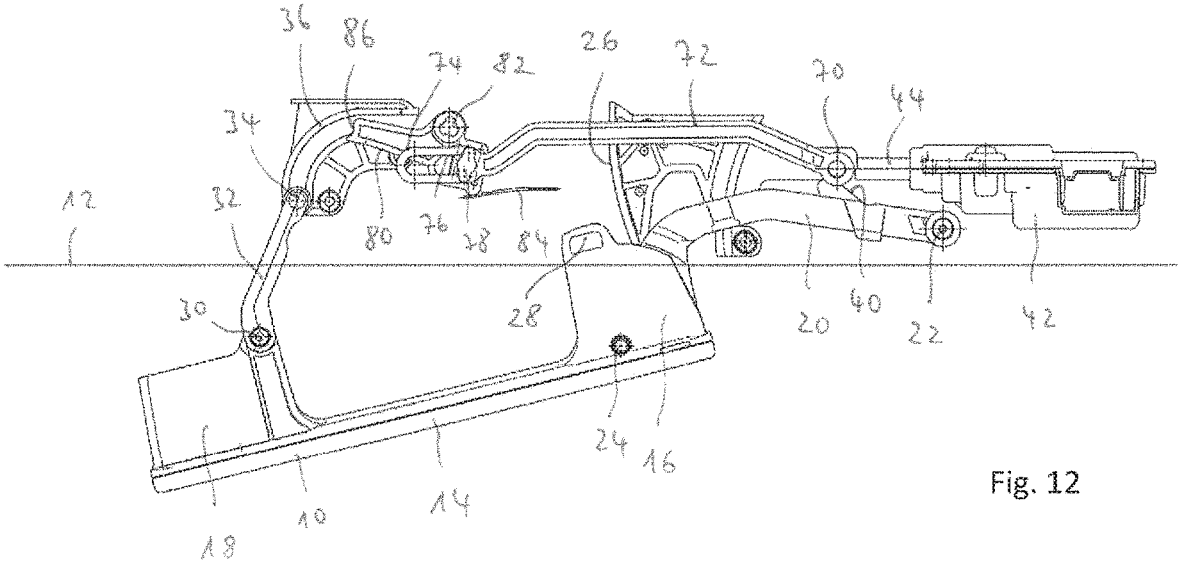

Exemplary embodiments of the invention will be explained in more detail below on the basis of figures in which, in each case schematically:

FIG. 1 shows a system according to the invention according to a first exemplary embodiment, in a partially sectional side view and in a first operating state, FIG. 2 shows the system from FIG. 1 in a second operating state, FIG. 3 shows the system from FIG. 1 in a third operating state, FIG. 4 shows the system from FIG. 1 in a fourth operating state, FIG. 5 shows a system according to the invention according to a second exemplary embodiment, in a partially sectional side view and in a first operating state, FIG. 6 shows the system from FIG. 5 in a second operating state, FIG. 7 shows the system from FIG. 5 in a third operating state, FIG. 8 shows the system from FIG. 5 in a fourth operating state, FIG. 9 shows the system from FIG. 5 in a fifth operating state, FIG. 10 shows a system according to the invention according to a third exemplary embodiment, in a partially sectional side view and in a first operating state, FIG. 11 shows the system from FIG. 10 in a second operating state, and FIG. 12 shows the system from FIG. 10 in a third operating state.

Unless stated otherwise, the same reference signs are used to denote identical objects in the figures. The system according to the invention shown in FIG. 1 comprises a door handle 10, in the illustrated example an exterior door handle 10 of an automobile, which in the closed position of the door handle as shown in FIG. 1 terminates flush with a surrounding exterior surface, indicated by the reference sign 12, of the automobile door. The door handle 10 has an elongate handle section 14, on the first end of which a first mounting section 16 is formed and on the second end of which a second mounting section 18 is formed. An actuation device for the door handle 10 comprises an actuation lever 20 which is composed of two lever arms which are connected to one another at an angle, for example at a right angle. The free end of one lever arm is mounted, so as to be pivotable about a pivot spindle 22 running perpendicularly into the plane of the drawing in FIG. 1, on a housing section of the system which is arranged fixedly on the automobile door. The free end of the other lever arm is connected to the first mounting section 16 so as to be pivotable about a pivot spindle 24 likewise running perpendicularly into the plane of the drawing in FIG. 1.

The actuation device furthermore comprises a slotted guide 26 which is arranged on a housing section of the system which is arranged fixedly on the automobile door. A guide section 28 of the first mounting section 16 is guided in the slotted guide 26. The guide section 28 may be formed by an end of a, for example, cylindrical guide bar. It is also possible for both ends of a guide bar of said type to form guide sections, wherein then two slotted guides may also be provided which are arranged on opposite sides of the first mounting section 16. In the example shown, spring means are provided which preload the actuation lever 20 clockwise about the pivot spindle 22 into the rest position of the actuation lever 20 as shown in FIG. 1. Furthermore, in the example shown, spring means are provided which preload the door handle 10 clockwise about the pivot spindle 24 into the closed position of the door handle 10 as shown in FIG. 1.

On the second mounting section 18 there is arranged an unlocking lever 32 which is pivotable about a pivot spindle 30 running perpendicularly into the plane of the drawing in FIG. 1. At its free end, the unlocking lever 32 likewise has at least one guide section 34, which in the present case is guided in a second slotted guide 36. The second slotted guide 36 is in turn arranged on a housing section which is arranged fixedly on the automobile door. The guide section 34 is connected to a Bowden cable 38 which acts on the door lock of the automobile door, as will be explained in more detail below. Again, it is also possible for two guide sections on the second mounting section, and if appropriate two second slotted guides, to be provided.

It can furthermore be seen in FIG. 1 that the actuation lever 20 has a ramp 40 which forms an oblique plane. The reference 42 denotes an electric motor of an electric linear drive which, via a drive part 44, drives a roller 46 which runs in rotatable fashion on the ramp 40. The roller 46 interacts with an abutment guide 48 running in the direction of movement of the drive part 44. If the roller 46 is driven by the electric motor 42 in the direction of the ramp 40, that is to say to the left in FIG. 1, this leads to the actuation lever 20 being pivoted about the pivot spindle 22. The pivoting movement of the actuation lever 20 is limited by a stop 50.

Whereas FIG. 1 shows the rest position of the actuation lever 20 and the closed position of the door handle 10, FIG. 2 illustrates an actuated position of the actuation lever 20 and of the door handle 10. To attain the actuated position, the electric motor 42 has been actuated such that, as explained above, the actuation lever 20 has been pivoted about the pivot spindle 22 counter to the preload of the spring means until it has reached the stop 50. As can be seen from a comparison of FIGS. 1 and 2, the guide section 28 on the right has, in the process, been guided along the curved path of the slotted guide 26. Owing to the configuration of the curved path defined by the slotted guide 26, the door handle 10 has, in the process, been moved in translational fashion from the closed position shown in FIG. 1 into the actuated position shown in FIG. 2. With regard to FIGS. 1 and 2, the mounting sections 16, 18 have thus been moved uniformly in parallel. In the process, the unlocking lever 32 coupled to the second mounting section 18 by way of the pivot spindle 30 has also been moved downward in the second slotted guide 36 by a first distance. In this position, unlocking of the door lock has not yet taken place. For this purpose, the door handle 10 is pulled manually from the actuated position shown in FIG. 2 into the open position shown in FIG. 3. In the process, the door handle 10 pivots, counter to the preload of the spring means, about the pivot spindle 24 relative to the actuation lever 20, which is held against the stop 50. The guide section 28 passes into a lateral protuberance 52 of the slotted guide 26. The guide section 34 is pulled further along the second slotted guide 36 as far as the bottom end 54, as shown in FIG. 3. In the process, unlocking of the door lock is performed via the Bowden cable 38, and the Bowden cable 38 is tensioned. In the example shown, the unlocking lever 32, by way of its guide section 34, actuates the Bowden cable 38 directly. It is however also possible, for example, for the unlocking lever 32 to actuate further levers in order to permit a transmission of forces and travels or in order to permit other outgoing directions for the Bowden cable.

As can be seen in FIG. 3, when the door handle 10 is in the open position, the roller 46 is no longer in contact with the ramp 40 of the actuation lever 20. Rather, the drive part 44 has been moved by the drive motor 42 back into the initial position shown in FIG. 1, such that the roller 46 has been removed from the ramp 40. If the door handle 10 is released from the open position shown in FIG. 3, the spring means provided in the region of the pivot spindles 22, 24 act, owing to their preload, so as to generate a pivoting movement of the actuation lever 20 and of the door handle 10 clockwise. As a result, the actuation lever 20 moves back into the rest position shown in FIG. 1, and the door handle 10 moves back into the closed position, likewise shown in FIG. 1. In the process, owing to the tension generated in the Bowden cable 38 during the course of the movement into the open position, the door lock is also locked again. The movement cycle of the door handle 10 is thus completed.

FIG. 4 illustrates an emergency unlocking position of the door handle in the event that, for example, the electric motor 42 of the linear drive is defective. In this case, the door handle 10 can, by manual exertion of pressure on the first mounting section, be pivoted counterclockwise about the pivot spindle 24 slightly, such that the door handle 10 projects out of the exterior surface 12 of the automobile door in the region of the second mounting section 18. In this emergency unlocking position, the guide section 28 is received in a second lateral protuberance 55 of the slotted guide 26. From the emergency unlocking position, the door handle 10 can be pivoted up manually about the pivot spindle 24 into an emergency open position, such that the door lock is unlocked by way of the Bowden cable 38.

A second exemplary embodiment of the invention will be explained in more detail on the basis of FIGS. 5 to 9. Said second exemplary embodiment substantially corresponds to the exemplary embodiment shown in FIGS. 1 to 4. Said second exemplary embodiment differs from the exemplary embodiment of FIGS. 1 to 4 with regard to the drive means for the actuation of the door handle 10. In the exemplary embodiment of FIGS. 5 to 9, no electric motor 42 is provided. It is pointed out that the ramp 40 and the abutment guide 48 are illustrated in FIGS. 5 to 9. In the exemplary embodiment of FIGS. 5 to 9, said ramp and abutment guide are however without function and are not required. In the exemplary embodiment of FIGS. 5 to 9, the drive means for moving the actuation lever 20 from the rest position into the actuated position, and thus for moving the door handle 10 from the closed position into the actuated position, comprise a drive lever 58 which is mounted, so as to be pivotable about a pivot spindle 56 running perpendicularly into the plane of the drawing in FIG. 5, on a housing section provided fixedly on the automobile door. The drive lever 58 interacts, by way of one end section 60 thereof (see FIG. 8), with the guide section 28 of the door handle 10. The drive lever 58 interacts, by way of its other end section 62, with the guide section 34 of the door handle 10. On the drive lever 58 there is formed a plunger 64, shown in particular in FIG. 7, of a push-push kinematic arrangement. A housing of the push-push kinematic arrangement is shown at reference sign 66. A control ring (not illustrated in any more detail) is mounted in axially fixed and rotatable fashion in the housing 66. The control ring has, on its inner side, at least one control projection which interacts in at least one control cam, formed on the outer side of the plunger 64, in order to realize a push-push function. The configuration of the control cam and the interaction of control ring with control cam may be configured, in a manner known per se, as described in DE 10 2008 057 933 B4.

In the closed position of the door handle 10 as shown in FIG. 5, the plunger 64 is situated in the housing 66 of the push-push kinematic arrangement. In particular, the plunger 64 is locked on the control ring of the push-push kinematic arrangement. The drive lever 58 is preloaded clockwise about the pivot spindle 56 by a suitable spring means. In the closed position shown in FIG. 5, owing to the locking of the push-push kinematic arrangement, the preload however cannot act on the drive lever 58 so as to rotate it clockwise. For unlocking, the door handle 10 is manually pushed inward into the unlocking position shown in FIG. 6. This results in unlocking of the plunger 64 from the control ring arranged in the housing 66 of the push-push kinematic arrangement. As a result, the spring means which preloads the drive lever 58 clockwise about the pivot spindle 56 can pivot the drive lever 58 clockwise into the position shown in FIG. 7. Here, the spring means which preload the drive lever 58 exhibit a more intense preload than the spring means which preload the actuation lever 20 clockwise about the pivot spindle 22. In this way, the drive lever 58 can push the guide section 28 downward along the slotted guide 26, with a pivoting movement of the actuation lever 20 counterclockwise about the pivot spindle 22 and with a translational movement of the door handle 10 into the actuated position shown in FIG. 7.

From the actuated position shown in FIG. 7, the door handle 10 can be pivoted up manually into the open position shown in FIG. 8 in the manner described above, with the door lock being unlocked. Owing to the interaction of the guide section 34 of the second mounting section 18 with the second end section 62 of the drive lever 58, the drive lever 58 is, during the course of the movement of the guide section 34 in the second slotted guide 36, pivoted back counterclockwise about the pivot spindle 56, counter to the preload of the drive lever 58. The plunger 64, which has previously emerged from the housing 66, moves into the housing 66 of the push-push kinematic arrangement again, and the plunger 64 locks on the control ring of the push-push kinematic arrangement again. In the open position shown in FIG. 8, the spring means which preload the drive lever 58 can correspondingly no longer impart an action. As a result, the door handle 10, after being released from the open position shown in FIG. 8, can automatically move back into the closed position shown in FIG. 5, in the manner described above with regard to the first exemplary embodiment, by being driven by the spring means which act clockwise on the pivot spindles 22, 24, without the spring means of the drive lever 58 exerting an opposing spring force.

FIG. 9 in turn shows an emergency unlocking position. This corresponds substantially to the emergency unlocking position explained above with regard to FIG. 4. As the first mounting section 16 is pushed inward, the second mounting section 18 of the door handle 10 pivots outward, such that the door handle 10 can subsequently be manually pivoted up into the emergency open position in order to unlock the door lock.

FIGS. 10 to 12 show a third exemplary embodiment of a system according to the invention. Said exemplary embodiment in turn substantially corresponds to the exemplary embodiment shown in FIGS. 1 to 4. For clarity, some parts of the system are not illustrated in FIGS. 10 to 12. This relates for example to the connection to the door lock for example by means of a Bowden cable, as has been basically explained with regard to the exemplary embodiments above. As in the case of the exemplary embodiment of FIGS. 1 to 4, it is the case in the exemplary embodiment of FIGS. 10 to 12 that the first mounting section 16 is guided by way of a schematically illustrated guide section 28 in a slotted guide 26. In FIGS. 11 and 12, the reference sign 26 denotes the curved path along which the first mounting section is guided by way of its guide section 28 which projects into the plane of the drawing in FIGS. 11 and 12. It may be ensured, for example by means of a curved path situated opposite the curved path shown in FIGS. 11 and 12, or in some other way, that the guide section 28 is guided along the curved path, as has basically also been shown in the preceding exemplary embodiments. The configuration of the slotted guide 26 and of the guide section 28 and also the guidance by the slotted guide 26 may thus basically be implemented as explained with regard to the exemplary embodiments above. The second mounting section 18 is, via the unlocking lever 32, guided by way of the guide section 34 in a second slotted guide 36, which is formed on a housing section arranged fixedly on the automobile door. By contrast to the exemplary embodiment in FIGS. 1 to 4, it is the case in the exemplary embodiment of FIGS. 10 to 12 that the drive part 44 of the electric motor 42 acts directly on the ramp 40 formed on the actuation lever 20. It would however also be possible for a roller to be provided as explained with regard to the exemplary embodiments above. Furthermore, a first end 70 of a thrust rod 72 is mounted on the free end of the drive part 44. On its opposite, second end 74, said thrust rod 72 has a slot 76 in which a blocking section 78, in the form of a blocking projection, of a blocking element 80, in the form of a pawl, is guided. The blocking element 80 is, by means of a mounting 82, mounted pivotably on the housing section provided fixedly on the automobile door. A spring 84 preloads the blocking element 80 into the release position shown in FIG. 10.

The function of the third exemplary embodiment of a system according to the invention as shown in FIGS. 10 to 12 shall be explained below. FIG. 10 shows the initial operating state in which the door handle is situated in its closed position, in which, in particular, it terminates flush with the exterior surface 12 of the automobile door. To attain the actuated position of the door handle 10 as shown in FIG. 11, the drive part 44 is extended, to the left in FIGS. 10 to 12, by the electric motor 42, wherein the drive part 44 is guided on the ramp 40 and thus leads to a pivoting movement of the actuation lever 20 counterclockwise about the pivot spindle 22, as explained above.

At the same time, the drive part 44 moves the thrust rod 72 to the left in FIGS. 10 to 12. Here, the blocking section 78 initially runs in the slot 76 without the blocking element 80 being actuated, in particular pivoted, about the pivot spindle 82. Only when the blocking section 78 reaches the right-hand end of the slot 76 in FIGS. 10 to 12 does the further axial movement of the thrust rod 72 lead to a pivoting movement of the blocking element 80 clockwise about the pivot spindle 82 and counter to the spring force of the spring 84. In the process, the free end 86 of the blocking element 80 comes into blocking engagement with that end of the unlocking lever 32 which has the guide section 34, as shown in FIG. 11. For as long as the electric motor 42 holds the drive part 44 in the extended position, the door handle 10 cannot be pushed inward from the actuated position shown in FIG. 11. Any pressure forces are reliably absorbed by the blocking element 80, without the possibility of damage to components of the system, in particular the thrust rod 72 or the drive components. The slotted guide 26 is in turn designed such that the movement, predefined by it, of the door handle 10 from the closed position shown in FIG. 10 into the actuated position shown in FIG. 11 (and back again) takes place in substantially translational fashion. Here, the mounting sections 16, 18 thus move substantially uniformly in parallel.

From the actuated position shown in FIG. 11, the door handle 10 can then be pivoted into the open position shown in FIG. 12 in the manner explained above with regard to the preceding exemplary embodiments. In the process, that end of the unlocking lever 32 which has the guide section 34 passes out of engagement with the free end 86 of the blocking element 80. If the drive part 44 is then retracted by the electric motor 42, the door handle 10 can, in the manner explained above, be moved back into the closed position shown in FIG. 10, if appropriate under the action of the preload spring means explained with regard to the exemplary embodiments above.

The invention claimed is:

1. A system composed of a door handle, which can be mounted in movable fashion in or on an automobile, and of an actuation device for the door handle, wherein the door handle has a handle section and two mounting sections arranged in the region of opposite ends of the handle section, characterized in that the actuation device comprises an actuation lever which, by one end thereof, is pivotably connected to a first of the mounting sections and, by the other end thereof, is mounted on a housing section so as to be pivotable between a rest position and an actuated position, wherein, when the actuation lever is in the rest position, the door handle assumes a closed position, and when the actuation lever is in the actuated position, the door handle assumes an actuated position from which the door handle can be pulled manually into an open position in order to unlock a door lock, wherein the actuation device comprises drive means for the movement of the actuation lever from the rest position into the actuated position, and wherein the actuation device furthermore comprises at least one slotted guide in which, at least during a movement of the actuation lever between the rest position and the actuated position, the first of the mounting sections or the second of the mounting sections is guided by way of at least one guide section such that the door handle is moved in substantially translational fashion between its closed position and its actuated position, wherein:

the door handle is pivotable between the actuated position and the open position about a pivot spindle which connects the actuation lever to the first of the mounting sections;

the at least one slotted guide which guides the at least one guide section of the first or second mounting section has, at its end which receives the guide section when the door handle is in the actuated position, a protuberance in which the at least one guide section is received when the door handle is in the open position; and the drive means comprises an electric linear drive which drives an element, which runs on a ramp of the actuation lever.

2. The system as claimed in claim 1, wherein spring means are provided which preload the actuation lever into the rest position, and/or in that spring means are provided which preload the door handle into the actuated position and/or the closed position.

3. A system composed of a door handle, which can be mounted in movable fashion in or on an automobile, and of an actuation device for the door handle, wherein the door handle has a handle section and two mounting sections arranged in the region of opposite ends of the handle section, characterized in that the actuation device comprises an actuation lever which, by one end thereof, is pivotably connected to a first of the mounting sections and, by the other end thereof, is mounted on a housing section so as to be pivotable between a rest position and an actuated position, wherein, when the actuation lever is in the rest position, the door handle assumes a closed position, and when the actuation lever is in the actuated position, the door handle assumes an actuated position from which the door handle can be pulled manually into an open position in order to unlock a door lock, wherein the actuation device comprises drive means for the movement of the actuation lever from the rest position into the actuated position, and wherein the actuation device furthermore comprises at least one slotted guide in which, at least during a movement of the actuation lever between the rest position and the actuated position, the first of the mounting sections or the second of the mounting sections is guided by way of at least one guide section such that the door handle is moved in a substantially linear fashion between its closed position and its actuated position, wherein:

the door handle is pivotable between the actuated position and the open position about a pivot spindle which connects the actuation lever to the first of the mounting sections; and the drive means comprises an electric linear drive which drives an element, which runs on a ramp of the actuation lever.

4. The system as claimed in claim 1, wherein, for emergency unlocking of the door lock, the door handle can be pivoted manually about the pivot spindle, which connects the actuation lever to the first mounting section, from the closed position into an emergency unlocking position, wherein the at least one slotted guide which guides the at least one guide section of the first or second mounting section has, at its end which receives the at least one guide section when the door handle is in the closed position, a protuberance in which the at least one guide section is received when the door handle is in the emergency unlocking position.

5. The system as claimed in claim 1, wherein the first mounting section is guided by way of at least one guide section in the at least one slotted guide, wherein, at least during a movement of the actuation lever between the rest position and the actuated position, the second mounting section is guided by way of at least one guide section in at least one second slotted guide, or in that the second mounting section is guided by way of at least one guide section in the at least one slotted guide, wherein, at least during a movement of the actuation lever between the rest position and the actuated position, the first mounting section is guided by way of at least one guide section in at least one second slotted guide.

6. The system as claimed in claim 1, wherein the second mounting section interacts with a door lock, which is to be actuated by way of the door handle, such that the door lock is unlocked when the door handle is in the open position.

7. The system as claimed in claim 1, wherein, on the second mounting section, there is pivotably mounted an unlocking lever, on the free end of which the at least one guide section is formed.

8. The system as claimed in claim 7, wherein the drive means is connected to a first end of a thrust rod, the second end of which acts on the unlocking lever such that, when the actuation lever is situated in the actuated position, a movement of the door handle from the actuated position into the closed position is prevented.

9. The system as claimed in claim 8, wherein the thrust rod interacts with a blocking element, in particular a pawl, which acts on the unlocking lever, in that the blocking element is mounted so as to be movable between a block position, which prevents a movement of the door handle from the actuated position into the closed position, and a release position, which permits a movement of the door handle from the actuated position into the closed position, in particular is mounted pivotably on a housing section, and in that the thrust rod moves the blocking element into its block position during a movement of the actuation lever into its actuated position by the drive means, and said thrust rod holds said blocking element in the block position for as long as the drive means are situated in a position which holds the actuation lever in the actuated position.

10. The system as claimed in claim 9, wherein the blocking element is preloaded into the release position by a spring element.

11. The system as claimed in claim 9, wherein the blocking element is guided, by way of a blocking section, in a slot formed on the second end of the thrust rod.

12. The system as claimed in claim 1, wherein the ramp has, along the movement travel of the element on the ramp, at least two sections of different gradient.

13. A system, comprising:

a door handle, which can be mounted in movable fashion in or on an automobile, and of an actuation device for the door handle, wherein the door handle has a handle section and two mounting sections arranged in the region of opposite ends of the handle section, the actuation device includes:

an actuation lever which, by one end thereof, is pivotably connected to a first of the mounting sections and, by the other end thereof, is mounted on a housing section so as to be pivotable between a rest position and an actuated position, wherein the actuation device is configured such that when the actuation lever is in the rest position, the door handle assumes a closed position, and when the actuation lever is in the actuated position, the door handle assumes an actuated position from which the door handle can be pulled manually into an open position in order to unlock a door lock; and a drive means for the movement of the actuation lever from the rest position into the actuated position;

at least one slotted guide in which, at least during a movement of the actuation lever between the rest position and the actuated position, the first of the mounting sections or the second of the mounting sections is guided by way of at least one guide section directly attached to the respective first mounting section or the second mounting section such that the door handle is moved in substantially translational fashion between its closed position and its actuated position, wherein;

the door handle is pivotable between the actuated position and the open position about a pivot spindle which connects the actuation lever to the first of the mounting sections;

the at least one slotted guide which guides the at least one guide section of the first or second of the mounting sections has, at its end which receives the guide section when the door handle is in the actuated position, a protuberance in which the at least one guide section is received when the door handle is in the open position; and the drive means comprises an electric linear drive which drives an element, which runs on a ramp of the actuation lever.

14. The system as claimed in claim 13, wherein the other of the first mounting section or the second mounting section, relative to at least one guide section attachment, is mounted to a second lever that is mounted to the housing.

15. The system as claimed in claim 13, wherein the first mounting section is guided by way of at least one guide section in the at least one slotted guide, wherein, at least during a movement of the actuation lever between the rest position and the actuated position, the second mounting section is guided by way of at least one guide section in at least one second slotted guide, or in that the second mounting section is guided by way of at least one guide section in the at least one slotted guide, wherein, at least during a movement of the actuation lever between the rest position and the actuated position, the first mounting section is guided by way of at least one guide section in at least one second slotted guide.

16. The system as claimed in claim 13, wherein the second mounting section interacts with a door lock, which is to be actuated by way of the door handle, such that the door lock is unlocked when the door handle is in the open position.

17. The system as claimed in claim 13, wherein, on the second mounting section, there is pivotably mounted an unlocking lever, on the free end of which the at least one guide section is formed.

18. The system as claimed in claim 13, wherein the ramp has, along the movement travel of the element on the ramp, at least two sections of different gradient.

19. The system as claimed in claim 3, wherein the at least one slotted guide which guides the at least one guide section of the first or second mounting section has, at its end which receives the guide section when the door handle is in the actuated position, a protuberance in which the at least one guide section is received when the door handle is in the open position.

* * * * *